US007313457B2

(12) United States Patent
Yoshimura et al.

(10) Patent No.: US 7,313,457 B2
(45) Date of Patent: Dec. 25, 2007

(54) EMBROIDERY DATA EDITOR THAT DISPLAYS USABLE EMBROIDERY FRAME

(75) Inventors: Ayako Yoshimura, Nagoya (JP); Tomohiko Mori, Inazawa (JP); Naoki Tanjima, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/387,886

(22) Filed: Mar. 24, 2006

(65) Prior Publication Data

US 2006/0224271 A1 Oct. 5, 2006

(30) Foreign Application Priority Data

Mar. 29, 2005 (JP) ..... 2005-093689

(51) Int. Cl.
*D05C 5/02* (2006.01)

(52) U.S. Cl. ..... 700/138; 700/136; 112/103; 112/470.09; 112/475.18; 112/475.19

(58) Field of Classification Search ..... 112/102.5, 112/103, 258, 470.01, 470.04, 470.09, 475.19, 112/475.18; 700/130, 136, 138
See application file for complete search history.

(56) References Cited

U.S. PATENT DOCUMENTS 4,960,061 A * 10/1990 Tajima et al. ..... 112/103
5,784,986 A * 7/1998 Morita ..... 112/102.5
5,803,000 A * 9/1998 Morita ..... 112/102.5
5,943,972 A * 8/1999 Hirata ..... 112/102.5
6,032,594 A * 3/2000 Komuro ..... 112/102.5
6,131,526 A * 10/2000 Iida et al. ..... 112/102.5

FOREIGN PATENT DOCUMENTS

JP 09-164282 6/1997

* cited by examiner

*Primary Examiner*—Gary L. Welch
*Assistant Examiner*—Nathan E Durham
(74) *Attorney, Agent, or Firm*—Oliff & Berridge, PLC

(57) ABSTRACT

A pattern selecting portion selects a desired embroidery pattern from a plurality of embroidery patterns. A pattern editing portion edits the embroidery pattern displayed on the display. A first determining portion determines, before the selected embroidery pattern is edited by the pattern editing portion, whether each of a plurality of embroidery frames is usable for sewing the selected embroidery pattern based on embroidery data for the selected embroidery pattern. A second determining portion determines, after the selected embroidery pattern is edited by the pattern editing portion, whether each of the plurality of embroidery frames is usable for sewing the edited embroidery pattern based on embroidery data for the edited embroidery pattern. A reporting portion reports when at least one embroidery frame determined to be usable by the second determining portion is different from at least one embroidery frame determined to be usable by the first determining portion.

20 Claims, 11 Drawing Sheets

EMBROIDERY DATA EDITOR THAT DISPLAYS USABLE EMBROIDERY FRAME

CROSS-REFERENCE TO RELATED APPLICATION

This application claims priority from Japanese Patent Application No. 2005-093689, filed Mar. 29, 2005, the disclosure of which is incorporated herein in its entirety by reference thereto.

BACKGROUND

The present disclosure relates to an embroidery data editor for editing a user-selected embroidery pattern based on embroidery data corresponding to the embroidery pattern, and particularly to an embroidery data editor that displays appropriate embroidery frames for use when sewing the embroidery pattern after the pattern has been edited.

Conventional embroidery sewing machines used to sew embroidery patterns on a cloth workpiece employ embroidery frames. The workpiece is mounted in the embroidery frame, and the embroidery frame is mounted on the embroidery sewing machine. Obviously, the embroidery frame must be sufficiently larger than the embroidery pattern to be sewed. However, when a plurality of embroidery frames having different sizes is employed, the user may become confused in determining which frame to use.

If the user mistakenly selects an embroidery frame that is smaller in size than the pattern to be sewn, the sewing needle will strike the embroidery frame and become damaged. Therefore, embroidery data editors have been proposed with a function to display appropriate embroidery frames for sewing an embroidery pattern selected and edited by the user.

For example, the embroidery data editor disclosed in U.S. Pat. No. 5,784,986 (corresponding to Japanese Patent Application Publication No. HEI-9-164282) is configured to display a plurality of embroidery patterns on a display device based on embroidery data corresponding to the embroidery patterns, enabling the user to select a desired embroidery pattern from among those displayed. Further, the embroidery data editor displays usable embroidery frames for the selected embroidery pattern, or alternatively deletes all unusable embroidery patterns, after the user has arranged the selected embroidery pattern in a desired position and orientation. The embroidery data editor having this configuration facilitates the user in determining a suitable embroidery frame and prevents the user from mistakenly selecting an unusable frame.

One such embroidery data editor disclosed in U.S. Pat. No. 5,784,986 displays on a display device embroidery frames that can be used for sewing a selected embroidery pattern or deletes unusable embroidery frames. At this time, if the user performs a desired editing process on the selected embroidery pattern in order to enlarge the pattern size, rotate the pattern, or shift the position of the pattern, for example, the usable embroidery frames displayed in the display device are changed.

SUMMARY

However, users inexperienced with the sewing operations often do not notice when the usable embroidery frames displayed in the display window have changed or do not check the display to verify whether the usable frames have changed and, consequently, begin the sewing operation after mounting an incorrect embroidery frame in the embroidery sewing machine. Especially when the display device has a small size or has a monochrome display, it is even more difficult to detect changes in the display. Therefore, users are more apt to miss changes in the usable embroidery frames.

In view of the foregoing, it is an object of the present disclosure to provide an embroidery data editor and a method of displaying embroidery frames, capable of preventing the user from mistakenly using an inappropriate embroidery frame.

In order to attain the above and other objects, according to one aspect, the present disclosure provides an embroidery data editor. The embroidery data editor includes a display, a pattern selecting portion, a display controlling portion, a pattern editing portion, a first determining portion, a second determining portion, and a reporting portion. The pattern selecting portion selects a desired embroidery pattern from a plurality of embroidery patterns. The display controlling portion controls the display to display the embroidery pattern selected by the pattern selecting portion. The pattern editing portion edits the embroidery pattern displayed on the display. The first determining portion determines, before the selected embroidery pattern is edited by the pattern editing portion, whether each of a plurality of embroidery frames is usable for sewing the selected embroidery pattern based on embroidery data for the selected embroidery pattern. The second determining portion determines, after the selected embroidery pattern is edited by the pattern editing portion, whether each of the plurality of embroidery frames is usable for sewing the edited embroidery pattern based on embroidery data for the edited embroidery pattern. The reporting portion reports when at least one embroidery frame determined to be usable by the second determining portion is different from at least one embroidery frame determined to be usable by the first determining portion.

According to another aspect, the present disclosure provides a method of displaying each embroidery frame usable for a selected embroidery pattern. The method includes selecting a desired embroidery pattern from a plurality of embroidery patterns, controlling a display to display the embroidery pattern selected in the selecting step, editing the embroidery pattern displayed on the display, determining, before the embroidery pattern selected in the selecting step is edited in the editing step, whether each of a plurality of embroidery frames is usable for sewing the selected embroidery pattern based on embroidery data for the selected embroidery pattern, determining, after the embroidery pattern selected in the selecting step is edited in the editing step, whether each of the plurality of embroidery frames is usable for sewing the edited embroidery pattern based on embroidery data for the edited embroidery pattern, and reporting when at least one embroidery frame determined to be usable in the determining step after editing is different from at least one embroidery frame determined to be usable in the determining step before editing.

BRIEF DESCRIPTION OF THE DRAWINGS

The above and other objects, features and advantages of the disclosure will become more apparent from reading the following description of the exemplary embodiments taken in connection with the accompanying drawings in which.

DETAILED DESCRIPTION

An embroidery data editor according to an embodiment of the present disclosure will be described while referring to the accompanying drawings.

The embroidery data editor according to the embodiment functions to edit an embroidery pattern that the user has selected from a plurality of pattern types and to warn the user through a blinking display when the embroidery frames usable for the selected pattern prior to editing the embroidery pattern differs from the embroidery frames usable for the selected pattern after the pattern has been edited.

Figure 1:
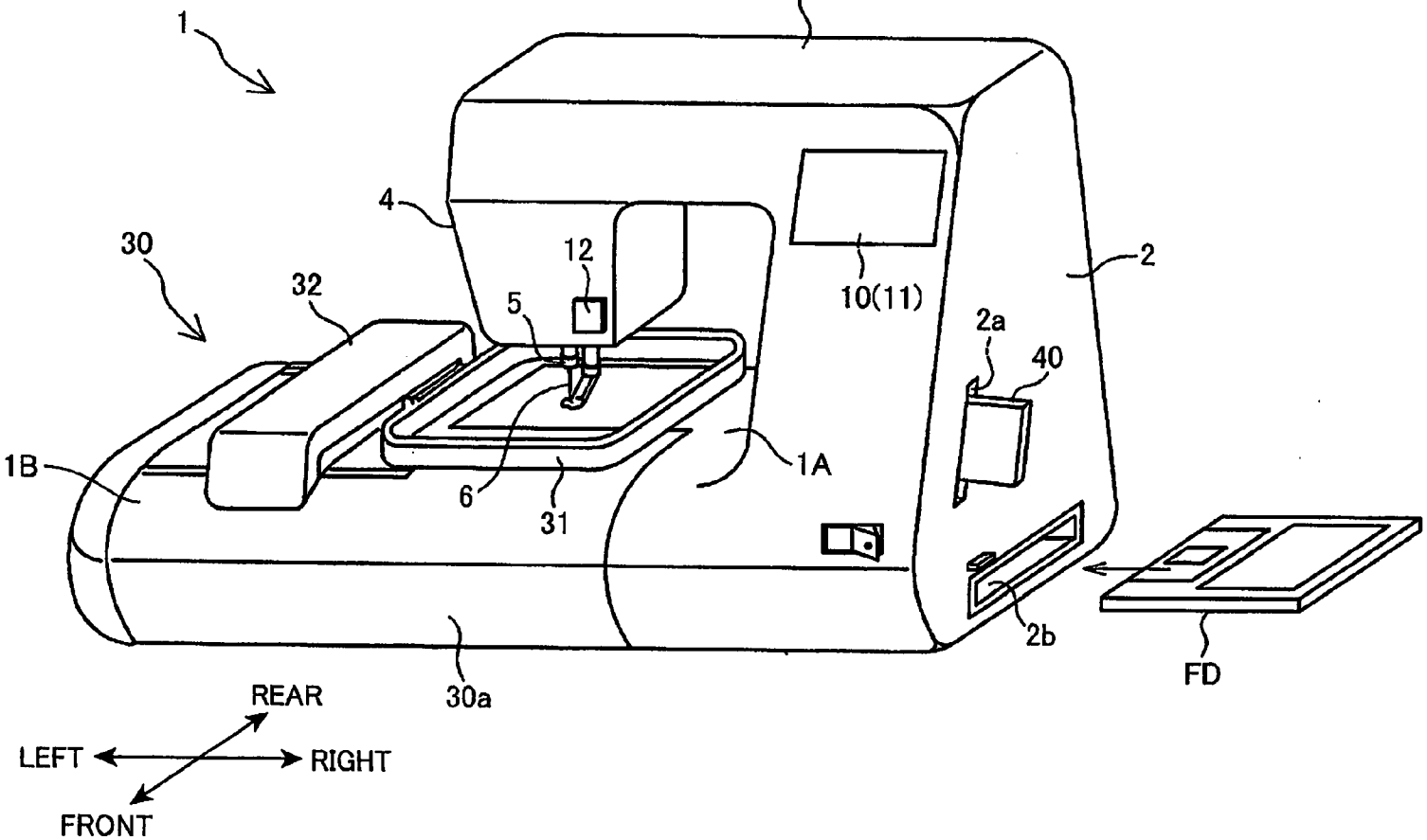
FIG. 1 is a perspective view of an electronically-controlled sewing machine according to an embodiment of the present disclosure.

FIG. 1 is a perspective view showing an electronically-controlled sewing machine 1 according to the embodiment. An embroidery frame driving device 30 described later is mounted on the sewing machine 1 for sewing embroidery patterns. The sewing machine 1 includes a sewing bed 1A, a pillar 2 erected from the right end of the sewing bed 1A in FIG. 1, and an arm 3 that extends leftward in FIG. 1 from the top end of the pillar 2 so as to confront the sewing bed 1A.

The sewing bed 1A is provided with a vertical feed dog moving mechanism (not shown) for moving a feed dog up and down; a horizontal feed dog moving mechanism (not shown) for moving the feed dog forward and rearward; a loop taker, such as a horizontal rotary hook, accommodating a bobbin and working in cooperation with a sewing needle 6; and the like.

The pillar 2 includes a card slot 2*a* and a disc slot 2*b* formed therein. The card slot 2*a* accepts an optionally provided ROM card 40 storing embroidery data for a plurality of embroidery patterns and facilitates connection of the ROM card 40 with an internal card connector 13 (see FIG. 2). The disc slot 2*b* enables a flexible disk FD to be inserted into a flexible disk drive (FDD) 29 (see FIG. 2).

The arm 3 includes a needle bar driving mechanism (not shown) for moving a needle bar 5 vertically, the needle bar 5 having the sewing needle 6 mounted in the bottom end thereof; a needle bar swinging mechanism (not shown) for swinging the needle bar 5 in a direction orthogonal to the direction in which the workpiece is fed; and a thread take-up driving mechanism (not shown) for driving a thread take-up (not shown) vertically in synchronization with the vertical movement of the needle bar 5. A sewing machine motor 17 (see FIG. 2) drives the vertical feed dog moving mechanism, the needle bar driving mechanism, and the thread take-up driving mechanism. A stepping motor 18 (see FIG. 2) drives the needle bar swinging mechanism. A stepping motor 19 (see FIG. 2) drives the horizontal feed dog moving mechanism.

The arm 3 includes a head portion 4 on the end farthest from the pillar 2. A start/stop switch 12 is provided on the head portion 4 for starting and stopping sewing operations. A color liquid crystal display (LCD; hereinafter simply referred to as the "display") 10 is provided on the front surface of the arm 3. The display 10 serves to display various stitching patterns, including utility patterns and embroidery patterns, the pattern names, various function names, and various messages.

Touch keys 11 formed of transparent electrodes are disposed in a matrix arrangement on the front surface of the display 10 at positions corresponding to the displayed positions of the embroidery patterns, pattern names, and function names. Hence, by pressing the touch key 11 corresponding to the desired embroidery pattern, pattern name, or function name, the user can select a desired embroidery pattern or indicate a function.

A free bed portion 1B, commonly called a free arm, is formed on the left end of the sewing bed 1A in FIG. 1. The embroidery frame driving device 30 (also referred to as an embroidery device) is detachably mounted on the free bed portion 1B.

The embroidery frame driving device 30 includes a main case 30*a*, an embroidery frame 31 in which a cloth workpiece is detachably mounted, a Y-direction driving unit 32, and an X-direction driving mechanism (not shown). The Y-direction driving unit 32 has a built-in Y-direction driving mechanism for moving the embroidery frame 31 mounted in a carriage (not shown) in a Y-direction (front-to-rear direction). The X-direction driving mechanism (not shown) is accommodated in the main case 30*a* for driving the Y-direction driving unit 32 in an X-direction (left-to-right direction). The embroidery frame driving device 30 also includes a first stepping motor 33 and a second stepping motor 34 (see FIG. 2) for driving the X-direction driving mechanism and the Y-direction driving mechanism, respectively.

When the embroidery frame driving device 30 is mounted on the free bed portion 1B, the first and second stepping motors 33 and 34 are electrically connected to a controller 20 (described later) of the sewing machine 1 via a connector 14 (described later). The controller 20 controls the driving of the first and second stepping motors 33 and 34 so that the embroidery frame 31 in which the workpiece is set can be moved independently in the X- and Y-directions, while the sewing machine motor 17 drives the needle bar 5 up and down to sew an embroidery pattern.

Figure 2:
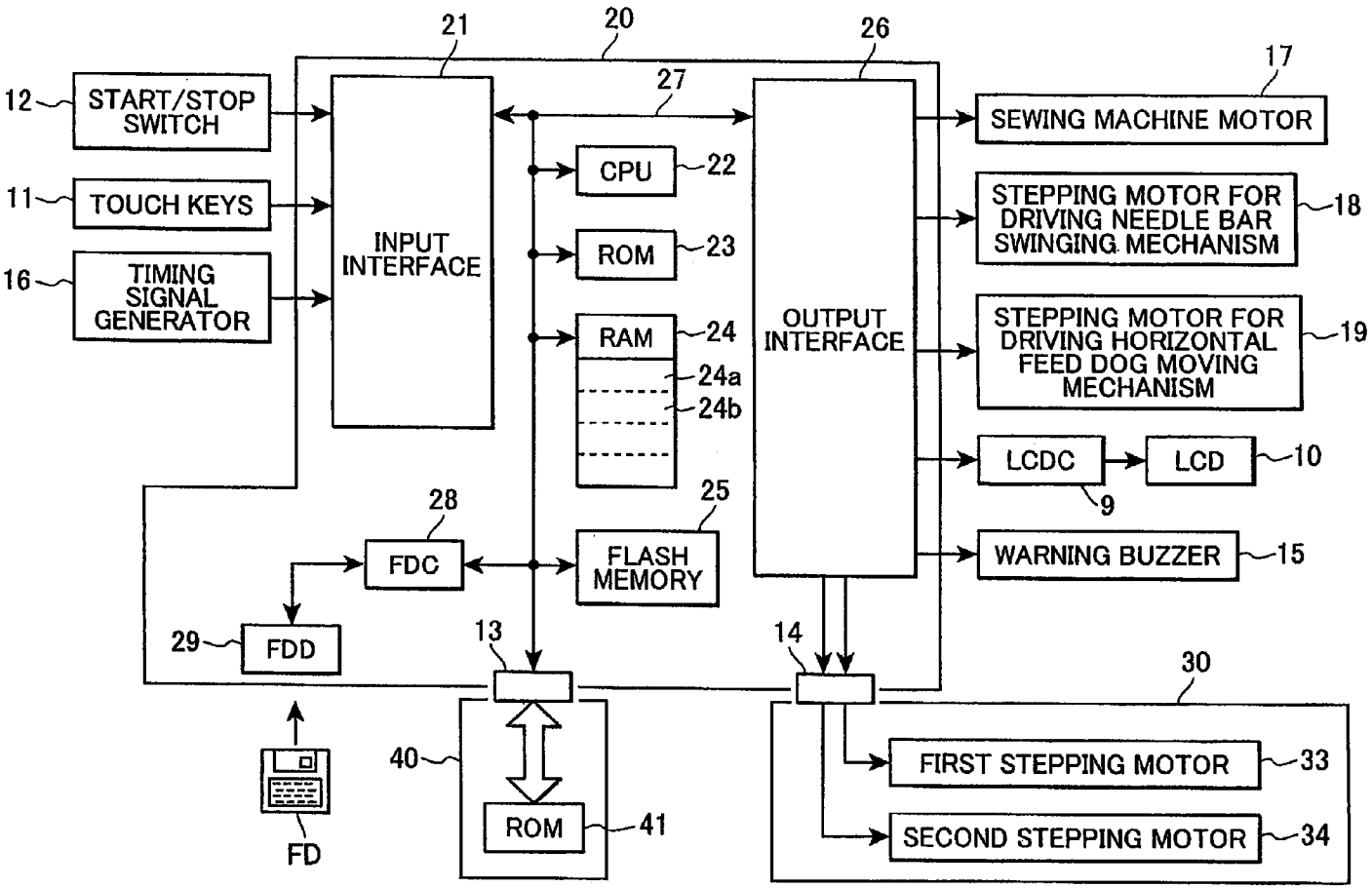
FIG. 2 is a block diagram showing a control system in the electronically-controlled sewing machine according to the embodiment.

Next, a control system of the sewing machine 1 will be described while referring to FIG. 2. The controller 20 includes an input interface 21; a computer that includes a CPU 22, a ROM 23, a RAM 24, and a nonvolatile flash memory 25 that can be electrically rewritten; a flexible disk controller (FDC) 28 for driving the flexible disk drive (FDD) 29; an output interface 26; and a data bus 27 connecting each of these components.

In addition to the data bus 27, the input interface 21 is also connected to the start/stop switch 12, the touch keys 11, a timing signal generator 16 for detecting the rotational phase of a main sewing shaft (not shown), and the like.

In addition to the data bus 27, the output interface 26 is also connected to the sewing machine motor 17, the stepping motor 18, and the stepping motor 19 described above, a display controller (LCDC) 9 for controlling the display 10, a warning buzzer 15 for producing a beeping sound to warn the user, the first and second stepping motors 33 and 34 in the embroidery frame driving device 30 via the connector 14, and the like. The ROM card 40 includes a ROM 41 that is connected to the data bus 27 via the internal card connector 13. The flexible disk controller (FDC) 28 is also connected to the data bus 27.

The ROM 23 stores embroidery frame data corresponding to each of three embroidery frames 31 (a large embroidery frame, medium embroidery frame, and small embroidery frame) described later and the range in which sewing can be performed in each; common control programs for controlling sewing of utility patterns by controlling how the feed dog feeds the workpiece and for controlling the display; an editing program for editing a selected embroidery pattern displayed on the display 10 through such processes as enlargement, reduction, and rotation; a sewing control program for sewing a selected embroidery pattern by controlling the embroidery frame driving device 30 for feeding the embroidery frame; a control program for controlling the editing of embroidery data described later, which is a feature of the present disclosure; and the like.

The RAM 24 is also provided with an embroidery data memory 24*a* for storing embroidery data for selected embroidery patterns; and an embroidery frame memory 24*b* for storing kinds of the embroidery frames 31 determined to be currently usable each time an editing process is executed. The RAM 24 is also provided with other memory areas necessary for performing the various control processes described above, such as memory areas for flags, pointers, counters, and the like, as well as registers and buffers.

Next, a routine executed by the controller 20 to control embroidery data editing will be described with reference to the flowchart in FIG. 3, where steps are abbreviated as Si (i=11, 12, 13 . . . ).

Figure 5:
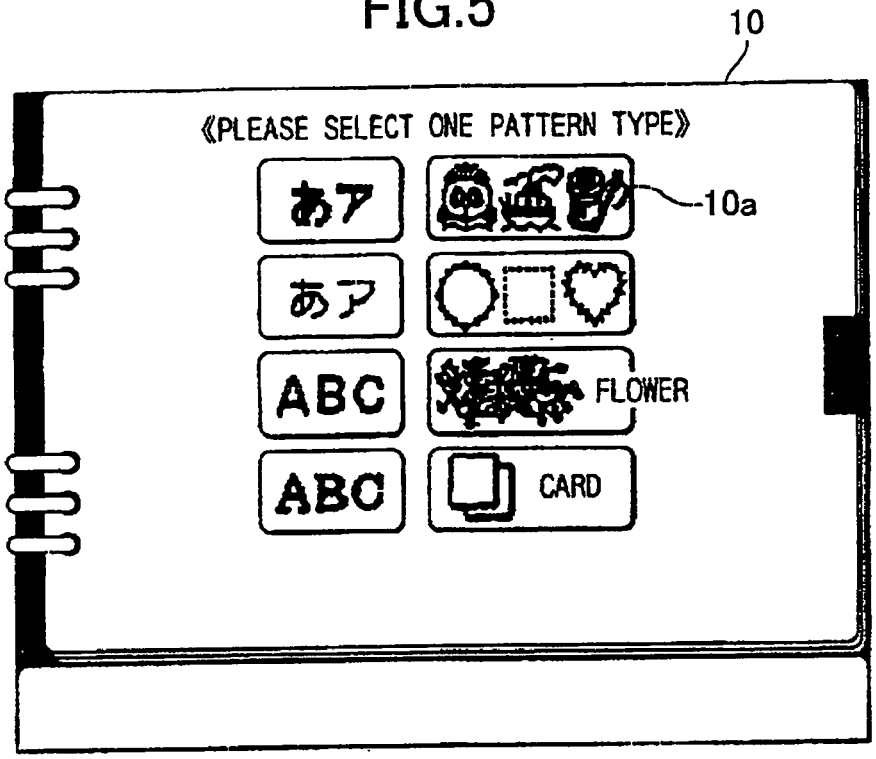
FIG. 5 is an explanatory diagram showing a window displayed for selecting a pattern type.
Figure 6:
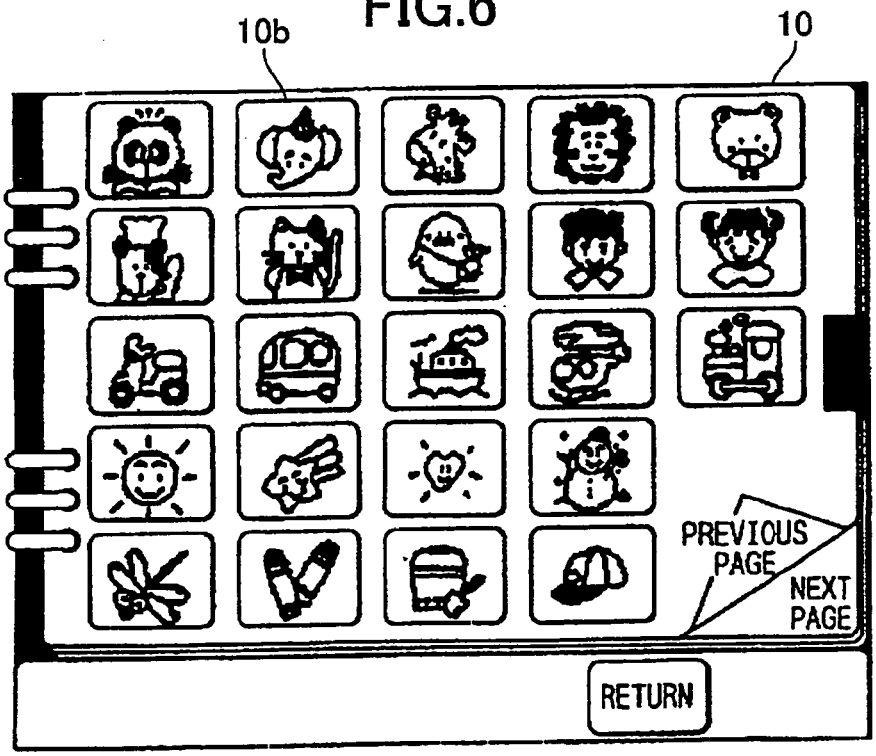
FIG. 6 is an explanatory diagram showing a window for selecting a pattern.

The controller 20 begins executing the control process when the user turns on the power to the sewing machine 1. After performing an initialization process to clear all areas in the RAM 24, the controller 20 displays a Pattern Type Selection window (see FIG. 5) on the display 10 in S11. The Pattern Type Selection window enables the user to specify a type (category) of pattern among embroidery data stored in the ROM 23 and a storage medium storing embroidery data (such as the ROM card 40 in FIG. 5). In S12 the controller 20 waits for the user to select a pattern type. Once the user has selected a pattern type (S12: YES), in S13 the controller 20 displays a Pattern Selection window (see FIG. 6) on the display 10. A Pattern Selection window enables the user to select a desired pattern from embroidery patterns belonging to the pattern type selected from the Pattern Type Selection window. For example, if the user selects "Animals and Vehicles" indicated by reference numeral 10*a* in FIG. 5, then patterns relevant to the category "Animals and Vehicles" are displayed, as shown in FIG. 6.

Figure 7:
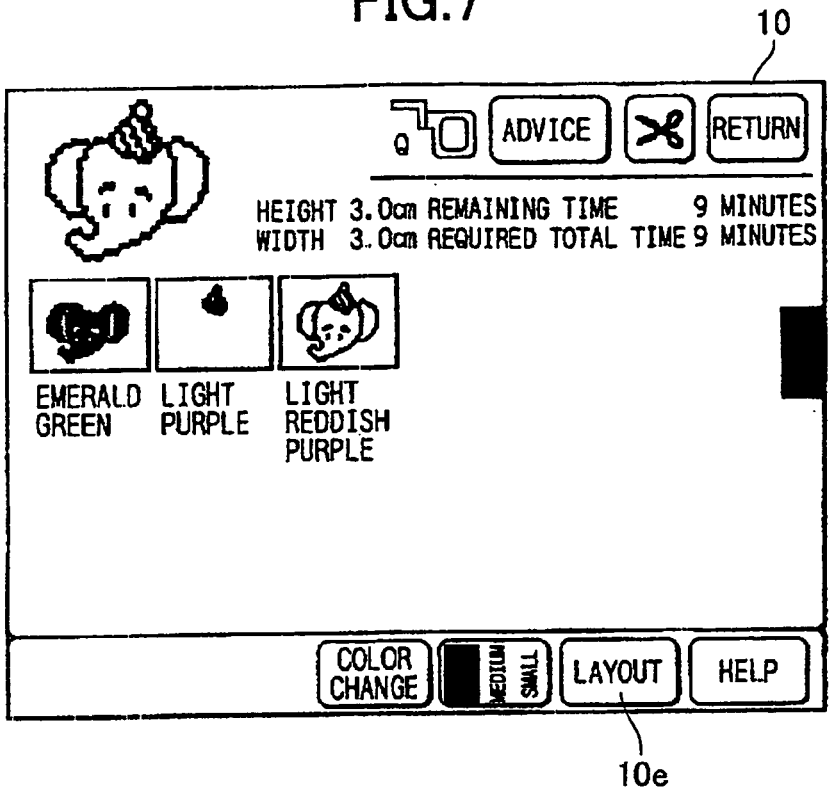
FIG. 7 is an explanatory diagram showing a window displaying the selected embroidery pattern.

In S14 the controller 20 determines whether the user has pressed the Return key. If the Return key has been operated (S14: YES), then the controller 20 returns to S11 and re-displays the Pattern Type Selection window. However, if the Return key has not been pressed (S14: NO), then in S15 the controller 20 waits until the user has selected a pattern. When the user has selected an embroidery pattern from the plurality of patterns displayed in the Pattern Selection window (S15: YES), then in S16 the controller 20 displays the selected embroidery pattern on the display 10. In this example, the user selects the elephant indicated by reference numeral 10*b* in FIG. 6, and the controller 20 displays the elephant embroidery pattern, as shown in FIG. 7.

In S17 the controller 20 again determines whether the user has pressed the Return key. If the Return key has been pressed (S17: YES, then the controller 20 returns to S13 and re-displays the Pattern Selection window. By repeatedly executing S13-S17, the user can select a plurality of patterns. In S18 the controller 20 determines whether the start/stop switch 12 has been operated. If the start/stop switch 12 has been operated (S18: YES), then in S26 the controller 20 executes an operation to begin sewing. However, if the start/stop switch 12 has not been operated (S18: NO), then in S19 the controller 20 determines whether a Layout key 10*e* has been pressed while the selected embroidery pattern shown in FIG. 7 is displayed on the display 10. If the Layout key 10*e* has been pressed (S19: YES), then in S20 the controller 20 displays a Layout window, shown in FIG. 8, on the display 10.

Figure 8:
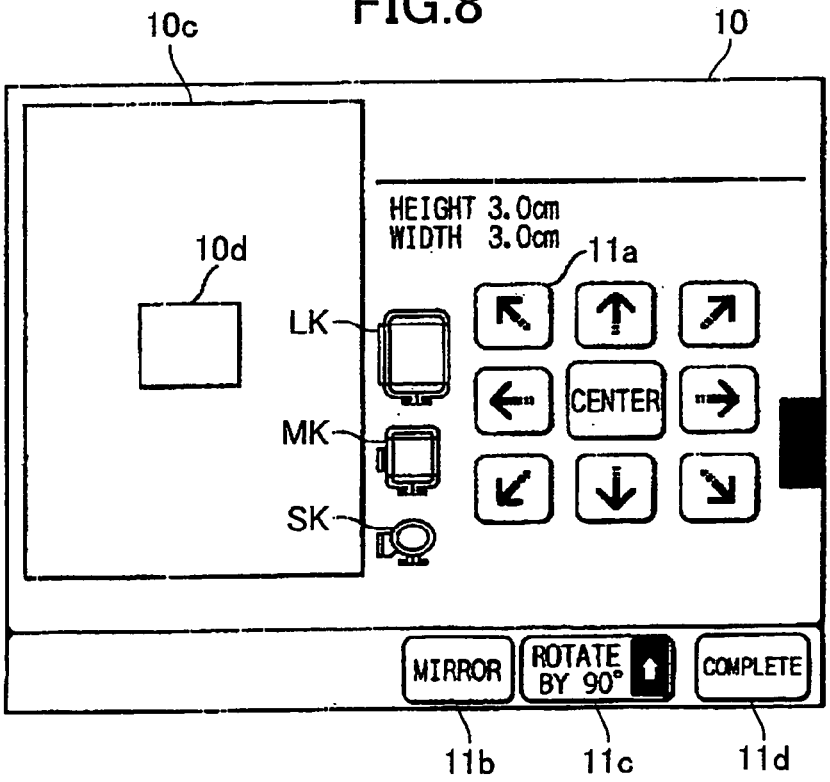
FIG. 8 is an explanatory diagram showing a Layout window.

As shown in FIG. 8, the Layout window includes a sewing range 10*c* of the sewing machine 1; a rectangular frame 10*d* indicating the size of the contours of a selected embroidery pattern (in this example, the frame for the selected elephant pattern has a height of 0.3.0 cm and width of 4.0 cm); directional keys 11*a* for moving the pattern in any of eight directions, a Mirror key 11*b*, a Rotate 90° key 11*c*, and a Complete key 11*d*; and a large embroidery frame LK for the embroidery frames 31 having a large sewing range, a small embroidery frame SK having a small sewing range, and a medium embroidery frame MK having a medium sewing range between the large sewing range and the small sewing range.

Immediately after the user has selected an embroidery pattern (that is, before the directional keys 11*a* are operated), the selected embroidery pattern is positioned centrally in the sewing range 10*c*, both top-to-bottom and left-to-right. Hence, after the embroidery pattern is selected in S15 and the Layout key 10*e* is pressed, the rectangular frame 10*d* for the selected embroidery pattern is displayed in the center of the sewing range 10*c*, as shown in FIG. 8.

The directional keys 11*a* function to move the rectangular frame 10*d* for the selected embroidery pattern within the sewing range 10*c*, moving incrementally by 0.1 mm each time the key is operated. The Mirror key 11*b* flips the rectangular frame 10*d* with the selected embroidery pattern left-to-right, producing its mirror image. The Rotate 90° key 11*c* functions to rotate the rectangular frame 10*d* with the selected embroidery pattern by 90 degrees in a predetermined direction. Hereafter, the directional keys 11*a*, Mirror key 11*b*, Rotate 90° key 11*c*, and the like will be referred to collectively as editing keys.

In S21 the controller 20 executes a control process for detecting embroidery frames. In this process, shown in the flowchart of FIG. 4, the controller 20 detects the usable embroidery frames 31 (large embroidery frame LK, medium embroidery frame MK, and small embroidery frame SK) based on the size and layout position of the rectangular frame 10*d* defining the embroidery pattern.

Figure 4:
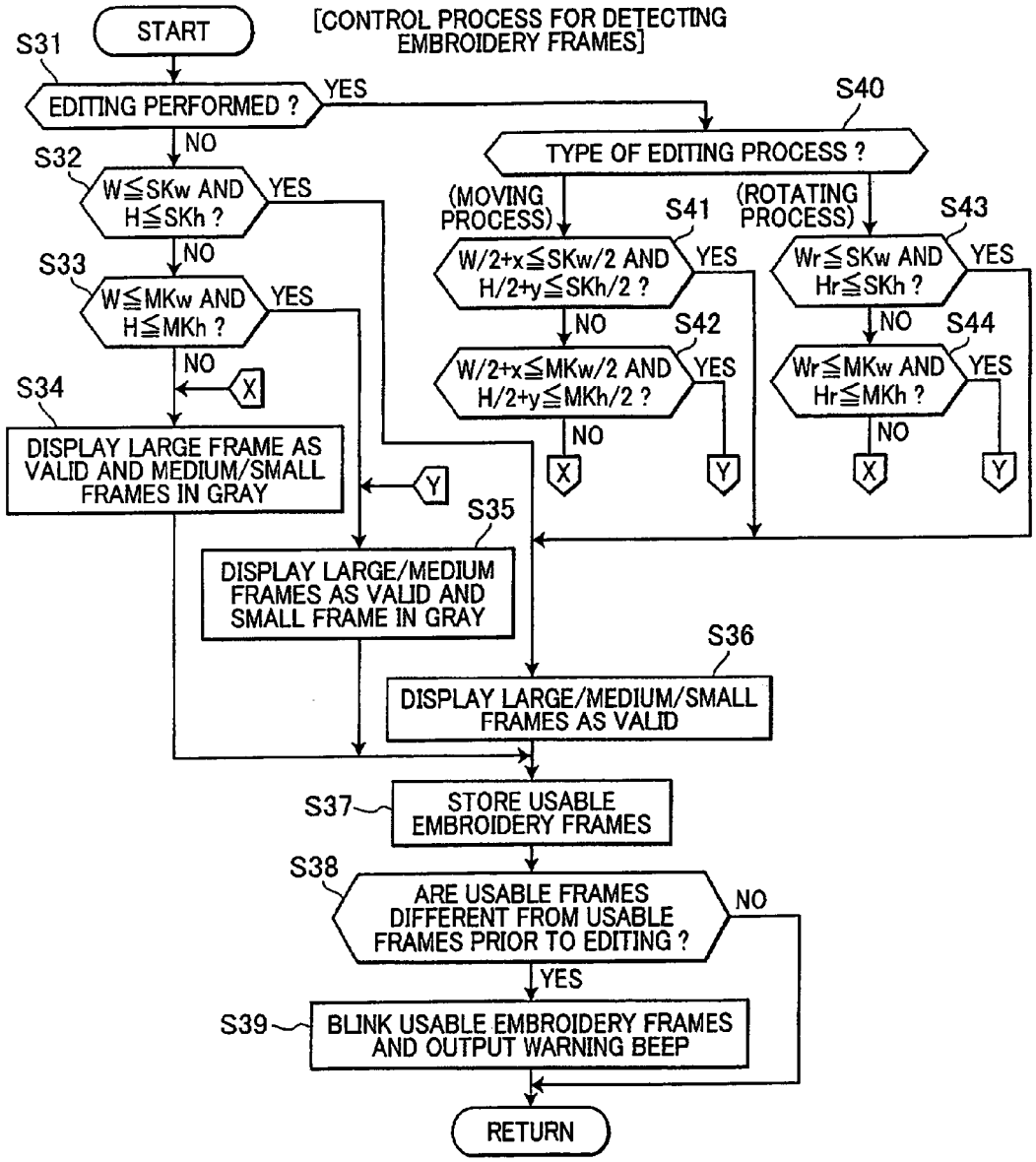
FIG. 4 is a flowchart illustrating steps in a control process for detecting embroidery frames.

At the beginning of this control process in FIG. 4, the controller 20 determines in S31 whether editing has been performed. If an editing key has not been pressed and, hence, an editing process has not been executed (S31: NO), then in S32 the controller 20 determines whether a width W of the selected embroidery pattern is less than or equal to a width SKw indicating the maximum width in which sewing can be performed in the small embroidery frame SK and whether a height H of the embroidery pattern is less than or equal to a height SKh indicating the maximum height dimension in which sewing can be performed in the small embroidery frame SK. If the width W and height H are less than or equal to the width SKw and height. SKh (S32: YES), then in S36 the controller 20 displays each of the embroidery frames LK, MK, and SK as being valid. Specifically, all of the embroidery frames are displayed with solid lines, as shown in FIG. 8. Displaying the embroidery frames with solid lines is an example of a first display mode.

Hence, the controller 20 determines which embroidery frames have a large enough sewing region to contain the embroidery pattern selected by the user before the pattern has been subjected to such editing processes as moving, flipping, and rotating. In this example, the controller 20 determines that all embroidery frames LK, MK, and SK can be used for sewing the selected embroidery pattern before the pattern has been edited. Therefore, the controller 20 displays all of the embroidery patterns as being valid (solid line display).

However, if the controller 20 determines in S32 that the selected embroidery pattern does not fit in the sewing range of the small embroidery frame SK (i.e., the small embroidery frame SK cannot be used; S32: NO), then in S33 the controller 20 determines whether the width W of the selected embroidery pattern is less than or equal to a width MKw indicating the maximum width in which sewing can be performed in the medium embroidery frame MK and whether the height H of the embroidery pattern is less than or equal to a height MKh indicating the maximum height in which sewing can be performed in the medium embroidery frame MK. If the width W and height H of the selected embroidery pattern are less than or equal to the width MKw and height MKh respectively (S33: YES), then in S35 the controller 20 displays the embroidery frames LK and MK as being valid (solid line display shown in FIG. 9) and displays the small embroidery frame SK in gray (halftone display shown in FIG. 9). Displaying the embroidery frames in gray is an example of a second display mode.

In other words, since the controller 20 determines that the embroidery pattern selected by the user and not yet subjected to an editing process does not fit within the sewing range of the small embroidery frame SK but does fit within the sewing ranges of the large embroidery frame LK and medium embroidery frame MK, the controller 20 determines that the embroidery frame LK and MK can be used for sewing the unedited embroidery pattern. Therefore, the controller 20 displays the usable embroidery frames LK and MK as being valid (solid line display) and the unusable embroidery frame SK in gray to indicate the frame is invalid.

However, if the controller 20 determines in S33 that the width W and the height H of the selected embroidery pattern are not less than or equal to the width MKw and height MKh (i.e., the embroidery pattern does not fit within the sewing region of the medium embroidery frame MK; S33: NO), then in S34 the controller 20 displays only the large embroidery frame LK as being valid (solid line display shown in FIG. 10) and displays both the embroidery frames MK and SK in gray.

Specifically, since the controller 20 determines that the selected embroidery pattern prior to editing only fits within the sewing region of the large embroidery frame LK, the controller 20 determines that only the large embroidery frame LK is usable for sewing the selected embroidery pattern. Therefore, the controller 20 displays the usable embroidery frame LK as being valid (solid line display) and displays the unusable embroidery frames MK and SK in gray to differentiate the invalid frames from the valid frame.

Note that, in the present embodiment, embroidery patterns larger than the large embroidery frame LK are not displayed on the display 10. Accordingly, the large embroidery frame LK is always usable. In other words, at least one embroidery frame is always usable.

In S37 the controller 20 stores the usable embroidery frames displayed as being valid in S34, S35, or S36 in the embroidery frame memory 24*b*. In S38 the controller 20 determines whether the usable embroidery frames differ from those prior to editing. Since the usable frames stored in the embroidery frame memory 24*b* at this time have not been edited (S38: NO), the controller 20 skips S39 and returns to the control process for editing embroidery data in FIG. 3.

Figure 3:
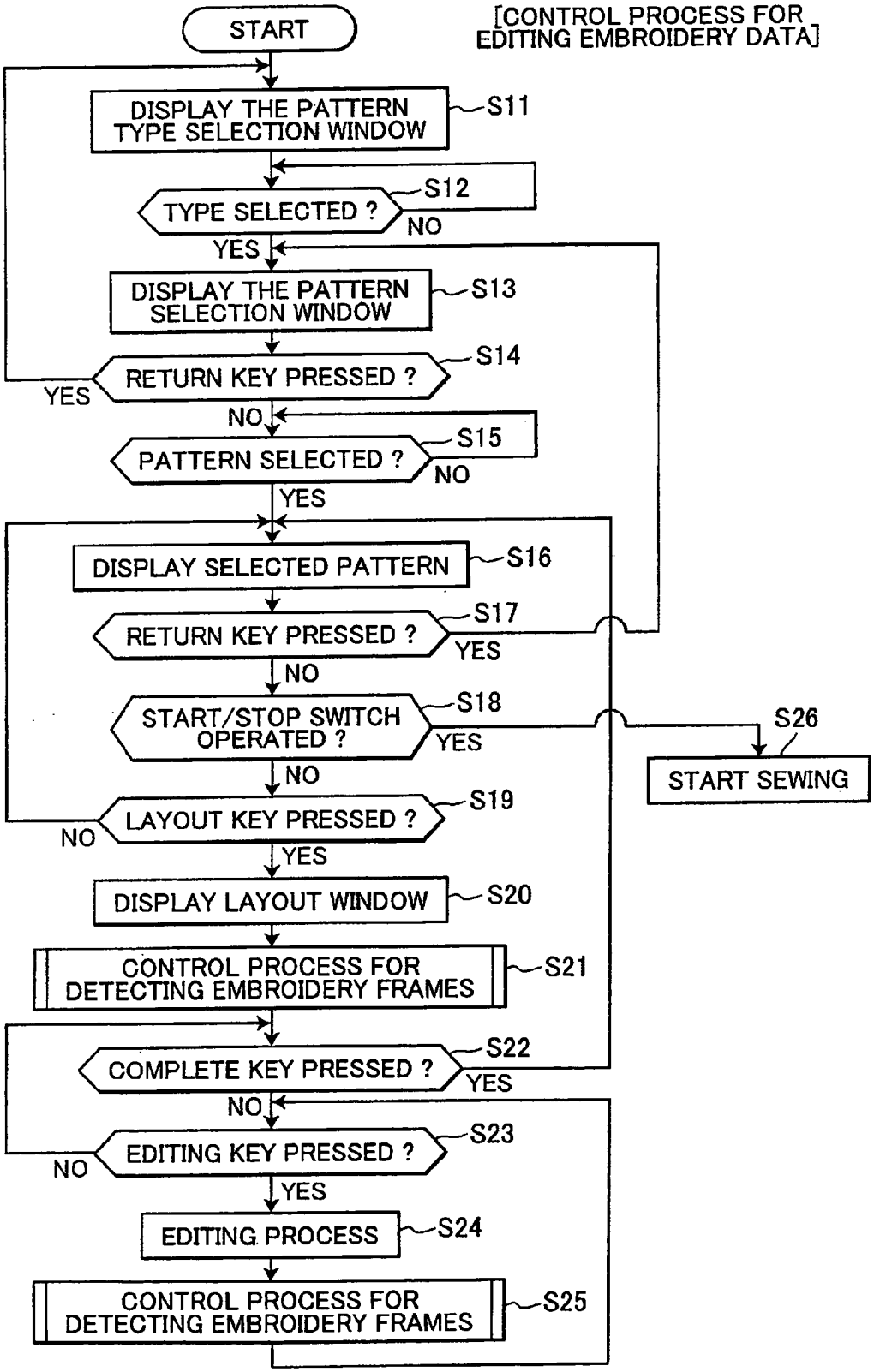
FIG. 3 is a flowchart illustrating steps in a control process for editing embroidery data.

In S22 of FIG. 3, the controller 20 determines whether the Complete key 11*d* has been pressed. If the Complete key 11*d* has been pressed (S22: YES), then the controller 20 returns to S16 and repeats the process described above. If the Complete key 11*d* has not been pressed in S22 (S22: NO), then in S23 the controller 20 determines whether one of the editing keys has been pressed. If an editing key has been pressed (S23: YES), then in S24 the controller 20 performs an editing process corresponding to the operated key. In S25 the controller 20 performs the control process for detecting the embroidery frames in FIG. 4 described above and returns to S23.

This time when the control process begins in FIG. 4, the controller 20 determines that an editing operation has been performed (S31: YES), and in S40 determines whether the editing process was a moving process or a rotating process. For example, if the process was a moving process in which the user operated the directional keys 11*a*, then in S41 the controller 20 determines whether one half of the width W of the selected embroidery pattern plus the amount of movement in the X-direction x produced by operating the directional keys 11*a* is less than or equal to one half of the width SKw ($W/2+x \leqq SKw/2$) and whether one half of the height H of the selected embroidery pattern plus the amount of movement in the Y-direction y produced by operating the directional keys 11*a* is less than or equal to one half of the height SKh ($H/2+y \leqq SKh/2$). The inequalities in S41 and S42 can be used because the selected embroidery pattern is positioned centrally in the sewing range 10*c*, both top-to-bottom and left-to-right, prior to editing. If so (S41: YES), then the controller 20 executes the process in S36. In other words, the controller 20 detects usable embroidery frames for the embroidery pattern after a movement process and displays these usable frames on the display 10, as described above. In this case, all embroidery frames are displayed as being valid.

However, if the embroidery pattern after the moving process cannot be sewed in the small embroidery frame SK (S41: NO), then in S42 the controller 20 determines whether one half of the width W of the selected embroidery pattern plus the amount of movement in the X-direction x is less than or equal to one half of the width MKw ($W/2+x \leqq MKw/$ 2) and whether one half of the height H of the selected embroidery pattern plus the amount of movement in the Y-direction y is less than or equal to one half of the height MKh (H/2+y≦MKh/2). If so (S42: YES), then the controller 20 executes the process in S35.

In this case, the controller 20 determines that the medium embroidery frame MK and the large embroidery frame LK can be used for sewing the embroidery pattern after the movement process, while the small embroidery frame SK is unusable, and displays the embroidery frames MK and LK as valid (solid line display) in the display 10, while displaying the small embroidery frame SK in gray. In this way, usable embroidery frames for the moved embroidery pattern can be displayed so as to be distinguishable from the unusable embroidery frames.

However, if the determination in S42 is "no", then the controller 20 executes the process in S34. Specifically, the controller 20 determines that only the large embroidery frame LK is usable for sewing the embroidery pattern after movement, and that the embroidery frames SK and MK are unusable, and the controller 20 displays the large embroidery frame LK as valid (solid line display) on the display 10, while displaying the embroidery frames SK and MK in gray. In this way, the usable embroidery frame for the embroidery pattern after movement can be displayed so as to be distinguishable from the unusable embroidery frames.

On the other hand, if the process determined in S40 is a rotating process, then in S43 the controller 20 determines whether a width Wr of the selected embroidery pattern after rotation is less than or equal to the width SKw (Wr≦SKw) and whether a height Hr of the selected embroidery pattern after rotation is less than or equal to the height SKh (Hr≦SKh). If so (S43: YES), then the controller 20 executes the process in S36. In other words, the controller 20 detects usable embroidery frames for the embroidery pattern after a rotating process and displays these usable frames on the display 10, as described above. In this case, all embroidery frames are displayed as being valid.

However, if the embroidery pattern after the rotating process cannot be sewed in the small embroidery frame SK (S43: NO), then in S44 the controller 20 determines whether the width Wr of the selected embroidery pattern after rotation is less than or equal to the width MKw (Wr≦MKw) and whether the height Hr of the selected embroidery pattern after rotation is less than or equal to the height MKh (Hr≦MKh). If so (S44: YES), then the controller 20 executes the process in S35.

In this case, the controller 20 determines that the medium embroidery frame MK and the large embroidery frame LK can be used for sewing the embroidery pattern after the rotating process, while the small embroidery frame SK is unusable, and displays the embroidery frames MK and LK as valid (solid line display) on the display 10, while displaying the small embroidery frame SK in gray. In this way, usable embroidery frames for the rotated embroidery pattern can be displayed so as to be distinguishable from the unusable embroidery frames.

However, if the determination in S44 is "no", then the controller 20 executes the process in S34. Specifically, the controller 20 determines that only the large embroidery frame LK is usable for sewing the embroidery pattern after rotation, and that the embroidery frames SK and MK are unusable, and the controller 20 displays the large embroidery frame LK as valid (solid line display) on the display 10, while displaying the embroidery frames SK and MK in gray. In this way, the usable embroidery frame for the embroidery pattern after rotation can be displayed so as to be distinguishable from the unusable embroidery frames.

Next, the controller 20 stores the usable embroidery frames displayed as valid in S34, S35, or S36 in the embroidery frame memory 24*b*. Note that the embroidery frame memory 24*b* includes two memory areas for storing both the usable frames prior to editing and the usable frames after editing. In S38 the controller 20 determines whether the embroidery frame data prior to editing and the embroidery frame data after editing, both stored in the embroidery frame memory 24*b*, are different from each other.

If the data for embroidery frames determined to be usable for sewing the embroidery pattern after editing and displayed as valid on the display 10 in S34, S35, or S36 differs from the data for embroidery frames determined to be usable prior to editing (S38: YES), then in S39 the controller 20 blinks the embroidery frames determined to be usable after the editing process and displayed as valid in S34, S35, or S36 and outputs a warning sound via the warning buzzer 15. In this way, the controller 20 notifies the user that the usable embroidery frames have changed after the editing process. Subsequently, the control process ends and the controller 20 returns to the control process for editing embroidery data in FIG. 3.

When the start/stop switch 12 is eventually pressed (S18: YES), in S26 the controller 20 begins the sewing operation. The controller 20 executes the sewing operation by driving the needle bar 5 (sewing machine motor 17) and the embroidery frame driving device 30 based on embroidery data for the embroidery pattern that has been edited with the editing keys.

Therefore, if all three embroidery frames LK, MK, and SK are found to be usable for sewing the embroidery pattern prior to editing, all three embroidery frames LK, MK, and SK are displayed as valid, as shown in FIG. 8. However, in this example, the embroidery frames MK and LK are determined to be usable after the editing process and are displayed as valid in FIG. 9, while the small embroidery frame SK is determined to be unusable and is displayed in gray. At this time, the embroidery frames MK and LK determined to be usable after the editing process are blinked on the display, and a warning beep is sounded. By the blinking display of the embroidery frames MK and LK and the beeping sound, the user can reliably recognize that the usable embroidery frames have changed.

Figure 9:
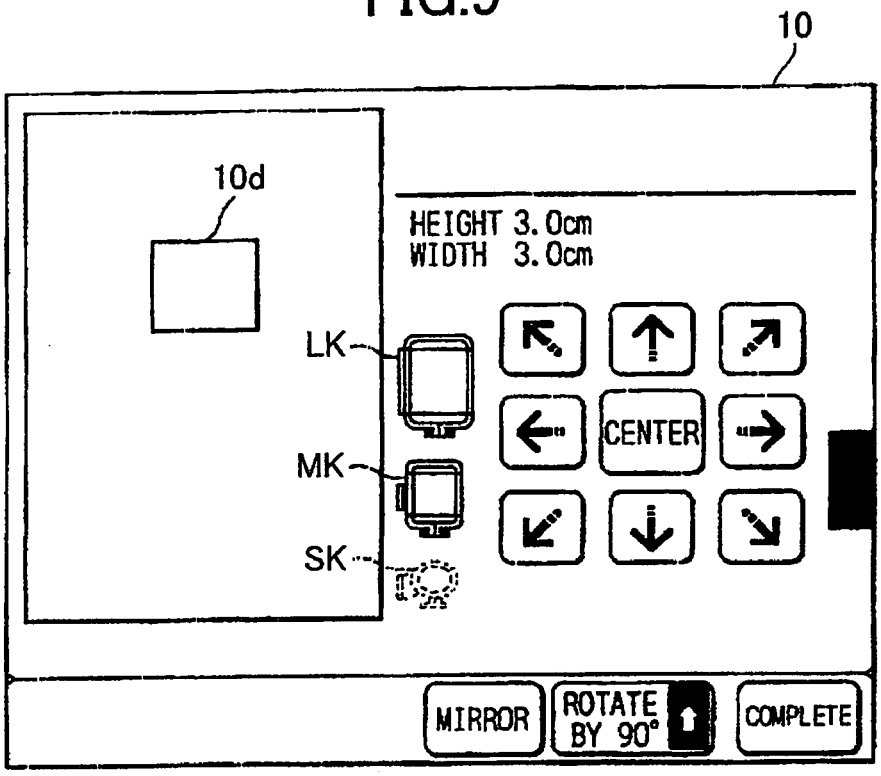
FIG. 9 is an explanatory diagram corresponding to FIG. 8 after a process is performed to move the pattern.
Figure 10:
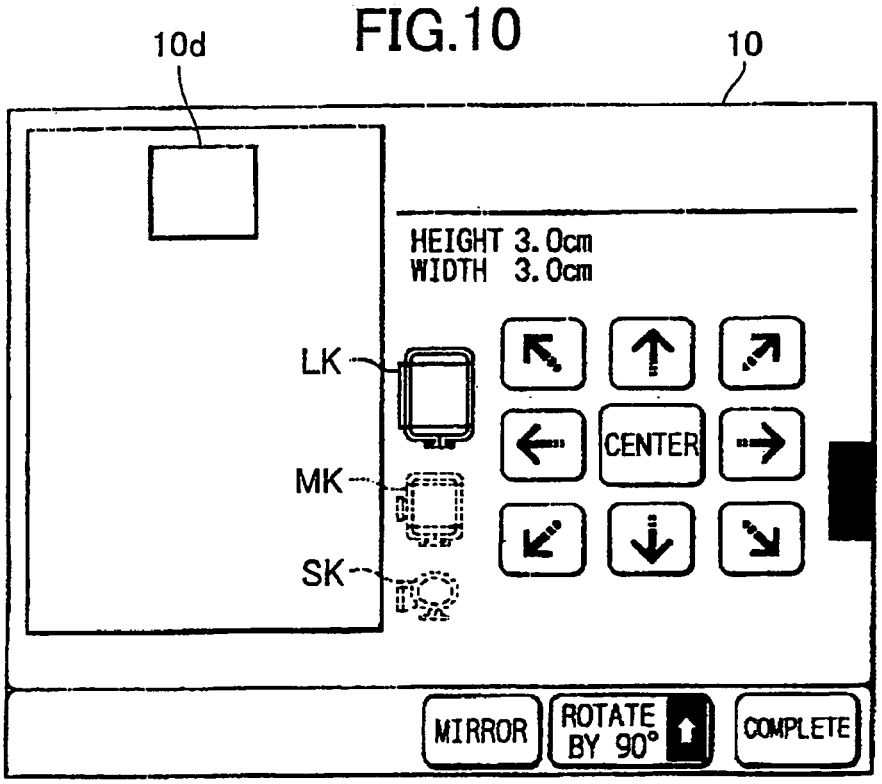
FIG. 10 is an explanatory diagram corresponding to FIG. 8 after a process is performed to move the pattern.

Further, when the embroidery frames MK and LK are determined to be usable for sewing the embroidery pattern prior to the editing process, the embroidery frames MK and LK are displayed as valid and the small embroidery frame SK in gray, as shown in FIG. 9. However, if only the large embroidery frame LK is determined to be usable after the editing process, only the large embroidery frame LK is displayed as valid, as shown in FIG. 10, while the embroidery frames SK and MK are determined to be unusable and are displayed in gray. At this time, only the large embroidery frame LK is blinked in the display and a warning beep is simultaneously sounded. Accordingly, through the blinking display of the embroidery frame LK and the beeping sound, the user can reliably recognize that the usable embroidery frames have changed.

While the disclosure has been described in detail with reference to the specific embodiment thereof, it would be apparent to those skilled in the art that various changes and modifications may be made therein without departing from the spirit of the disclosure.

Figure 11:
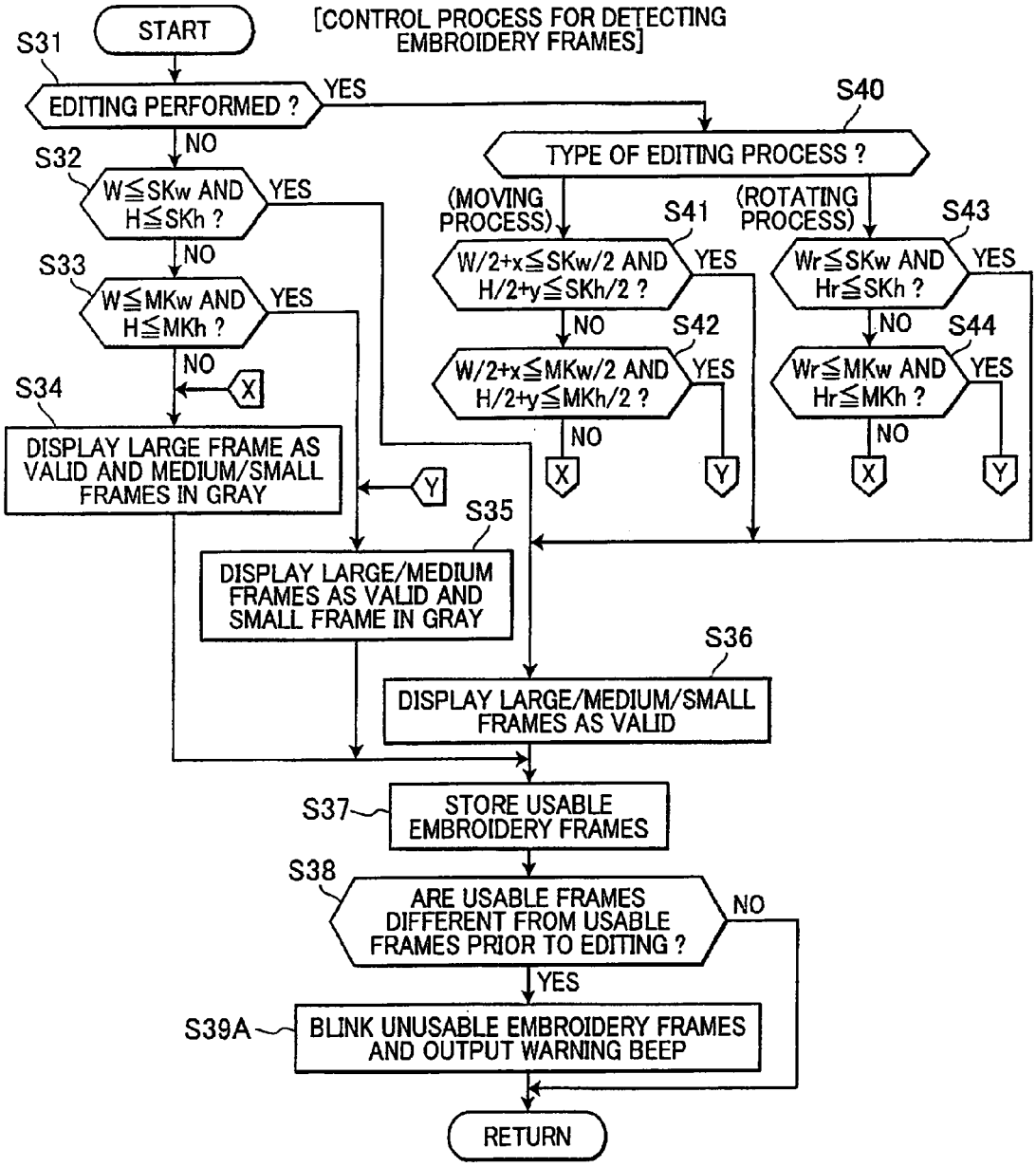
FIG. 11 is a flowchart illustrating steps in a control process for detecting embroidery frames according to a modification.

1) As shown in FIG. 11, the control process for detecting embroidery frames according to the above-described embodiment may be changed partially to blink the embroidery frames determined to be unusable after an editing process has been performed. Here, only the part differing from the above-described embodiment will be described. When the controller 20 determines in S38 that the embroidery frames determined to be usable after the editing process differ from the editing frames determined to be usable prior to the editing process (S38: YES), then in S39A the controller 20 blinks the embroidery frames determined to be unusable after the editing process and displayed in gray and issues a warning sound from the warning buzzer 15. Further, after blinking these unusable embroidery frames for a predetermined time, the unusable embroidery frames may be deleted from the display 10. This modification can achieve the same effects as the embodiment described above.

Figure 12:
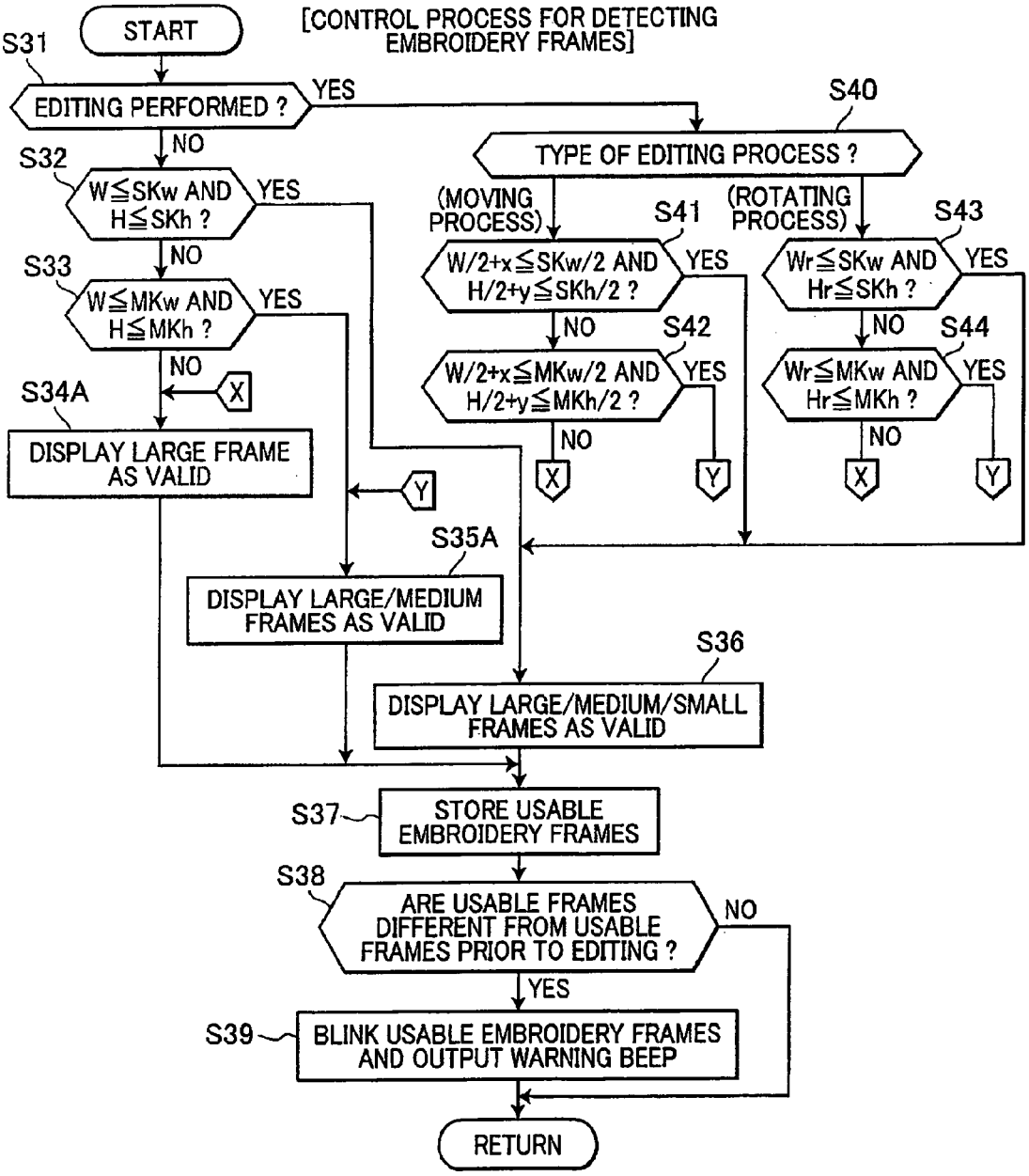
FIG. 12 is a flowchart illustrating steps in a control process for detecting embroidery frames according to another modification.

2) The control process for detecting embroidery frames described above may also be partially modified as shown in FIG. 12. In this modification, only usable embroidery frames are displayed as valid in S34A and S35A, while embroidery frames determined to be usable after the editing process are blinked on the display.

Figure 13:
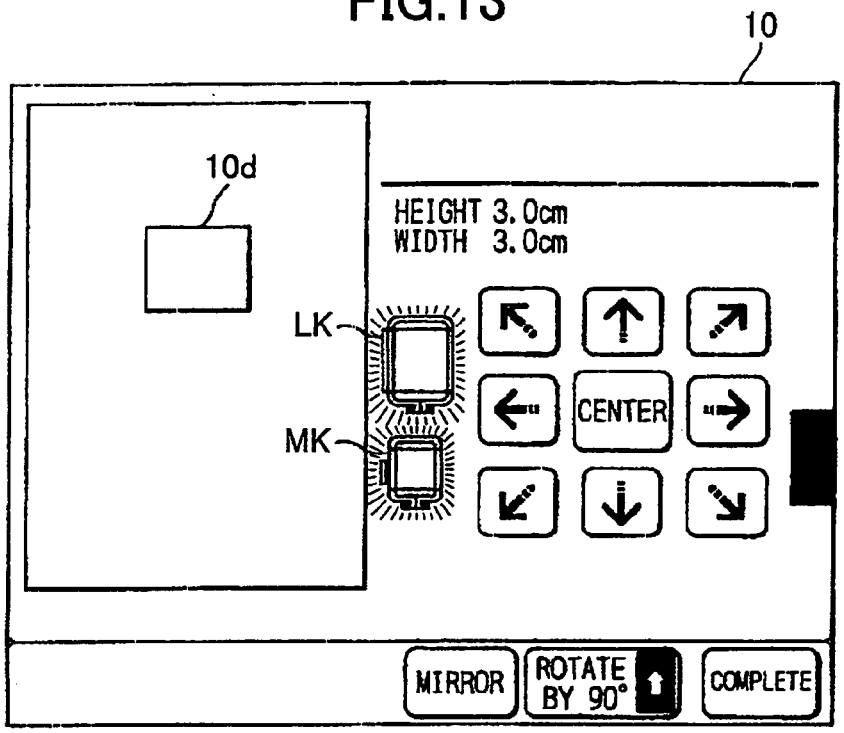
FIG. 13 is an explanatory diagram showing a blinking display in the Layout window of usable embroidery frames.

In other words, when all three embroidery frames LK, MK, and SK are found to be usable prior to an editing process being performed, all embroidery frames LK, MK, and SK are displayed as valid, as shown in FIG. 8. However, if the embroidery frames MK and LK are determined to be usable after an editing process is performed, then these two embroidery frames LK and MK are displayed as valid and blinked on the display, as shown in FIG. 13. However, the small embroidery frame SK determined to be unusable after the editing process is not displayed. This modification can achieve the same effects as the embodiment described above.

Figure 14:
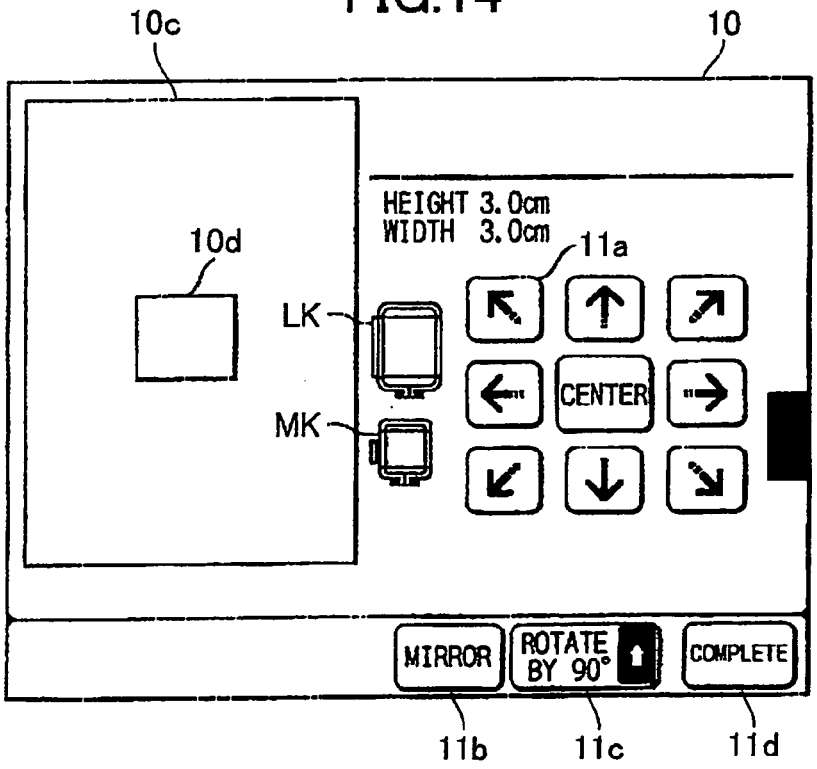
FIG. 14 is an explanatory diagram showing a display of embroidery frames in the Layout window.

3) The control process for detecting embroidery frames described above may also be modified by blinking the embroidery frames determined usable prior to an editing process and also determined to be usable after the editing process. Specifically, if the embroidery frames LK and MK are found to be usable prior to the editing process, both the embroidery frames LK and MK are displayed as valid, as shown in FIG. 14, while the unusable small embroidery frame SK is not displayed.

Figure 15:
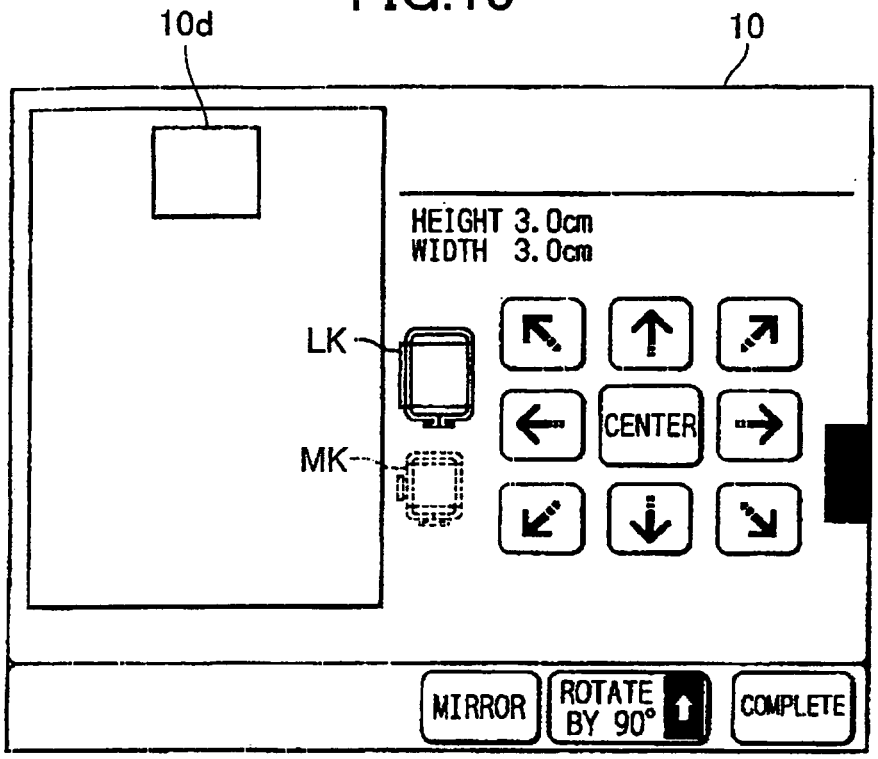
FIG. 15 is an explanatory diagram showing a blinking display in the Layout window of usable embroidery frames.

Of these two embroidery frames LK and MK, if only the large embroidery frame LK is found to be usable after an editing process is performed, then the usable large embroidery frame LK is displayed as valid and the unusable medium embroidery frame MK is displayed in gray, as shown in FIG. 15. Moreover, the usable large embroidery frame LK is blinked on the display. This modification can obtain the same effects as in the embodiment described above.

4) The control process for detecting embroidery frames described above may also be modified by blinking embroidery frames determined usable prior to an editing process but determined unusable after the editing process. Specifically, if the embroidery frames LK and MK are found to be usable prior to the editing process, both the embroidery frames LK and MK are displayed as valid, as shown in FIG. 14, while the unusable small embroidery frame SK is not displayed.

Figure 16:
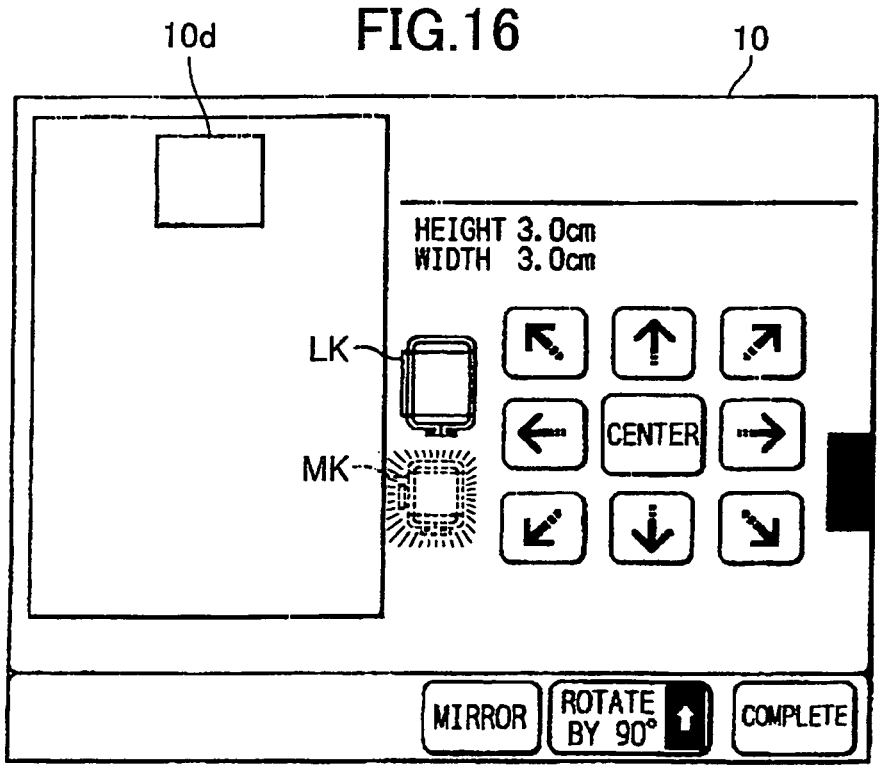
FIG. 16 is an explanatory diagram showing a blinking display in the Layout window of unusable embroidery frames.

Of these two embroidery frames LK and MK, if only the large embroidery frame LK is found to be usable after an editing process is performed, then the usable large embroidery frame LK is displayed as valid and the unusable medium embroidery frame MK is displayed in gray, as shown in FIG. 16. Moreover, the unusable medium embroidery frame MK is blinked on the display. This modification can obtain the same effects as in the embodiment described above.

5) According to another modification, in S39 (FIG. 4) or S39A (FIG. 11) of the control process for detecting embroidery frames, the embroidery frames blinked on the display may be rendered in red, green, or another striking color. Additionally, the blinking embroidery frames or non-blinking embroidery frames may be distinguished by rocking or rotating the displayed image. Further, the sewing machine 1 may be equipped with a speaker instead of the warning buzzer 15, and a message may be outputted through the speaker.

6) Further, a process for moving or rotating the embroidery pattern was given as an example of an editing process in the embodiment described above. However, the editing process is not limited to a moving process and rotating process, but may be a process to reverse the embroidery pattern left-to-right, and enlarge or reduce the pattern. As in the example of the embodiment described above, in any other editing process as well, the controller 20 reports changes in the embroidery frames determined to be usable after the editing process has been performed.

7) In the embodiment described above, the control process for detecting embroidery frames prior to an editing process (S21) is performed after the Layout key 10*e* is pressed (S19). However, the control process for detecting embroidery frames prior to an editing process (S21) may be performed after an embroidery pattern is selected in S15 and before the selected pattern is displayed in S16. In this modification, in S16 the usable embroidery frames are displayed in the window displaying the selected patterns shown in FIG. 7.

What is claimed is:

1. An embroidery data editor comprising:

a display; and a controller that:

selects a desired embroidery pattern from a plurality of embroidery patterns;

controls the display to display the selected embroidery pattern;

edits the embroidery pattern displayed on the display;

determines, using a first determining portion, before the selected embroidery pattern is edited, whether each of a plurality of embroidery frames is usable for sewing the selected embroidery pattern based on embroidery data for the selected embroidery pattern;

determines, using a second determining portion, after the selected embroidery pattern is edited, whether each of the plurality of embroidery frames is usable for sewing the edited embroidery pattern based on embroidery data for the edited embroidery pattern; and reports when at least one embroidery frame determined to be usable by the second determining portion is different from at least one embroidery frame determined to be usable by the first determining portion, the report being made by a blinking visual notification, an audible notification, or a combination of both.

2. The embroidery data editor according to claim 1, wherein the controller: displays each embroidery frame determined to be usable by the first determining portion in a first display mode, and displays each embroidery frame determined to be unusable by the first determining portion in a second display mode, the second display mode being distinguishable from the first display mode;

displays each embroidery frame determined to be usable by the second determining portion in the first display mode, and displays each embroidery frame determined to be unusable by the second determining portion in the second display mode; and reports by blinking on the display, each embroidery frame determined to be usable by the second determining portion.

3. The embroidery data editor according to claim 2, wherein each embroidery frame is displayed with solid lines in the first display mode.

4. The embroidery data editor according to claim 2, wherein each embroidery frame is displayed in gray in the second display mode.

5. The embroidery data editor according to claim 2, further comprising a sound outputting device that generates the audible notification.

6. The embroidery data editor according to claim 1, wherein the controller: displays each embroidery frame determined to be usable by the first determining portion in a first display mode, and displays each embroidery frame determined to be unusable by the first determining portion in a second display mode, the second display mode being distinguishable from the first display mode;

displays each embroidery frame determined to be usable by the second determining portion in the first display mode, and displays each embroidery frame determined to be unusable by the second determining portion in the second display mode; and reports by blinking on the display, each embroidery frame determined to be unusable by the second determining portion.

7. The embroidery data editor according to claim 1, wherein the controller: displays each embroidery frame determined to be usable by the first determining portion;

displays each embroidery frame determined to be usable by the second determining portion; and reports by blinking on the display, each embroidery frame determined to be usable by the second determining portion.

8. The embroidery data editor according to claim 1, wherein the controller: displays each embroidery frame determined to be usable by the first determining portion in a first display mode;

displays each embroidery frame determined to be usable by the second determining portion in the first display mode, and displays each embroidery frame determined to be unusable by the second determining portion in a second display mode, the second display mode being distinguishable from the first display mode; and reports by blinking on the display, each embroidery frame determined to be usable by the second determining portion.

9. The embroidery data editor according to claim 1, wherein the controller: displays each embroidery frame determined to be usable by the first determining portion in a first display mode;

displays each embroidery frame determined to be usable by the second determining portion in the first display mode, and displays each embroidery frame determined to be unusable by the second determining portion in a second display mode, the second display mode being distinguishable from the first display mode; and reports by blinking on the display, each embroidery frame determined to be unusable by the second determining portion.

10. A method of displaying each embroidery frame usable for a selected embroidery pattern, the method comprising:

selecting a desired embroidery pattern from a plurality of embroidery patterns;

controlling a display to display the embroidery pattern selected in the selecting step;

editing the embroidery pattern displayed on the display;

determining, before the embroidery pattern selected in the selecting step is edited in the editing step, whether each of a plurality of embroidery frames is usable for sewing the selected embroidery pattern based on embroidery data for the selected embroidery pattern;

determining, after the embroidery pattern selected in the selecting step is edited in the editing step, whether each of the plurality of embroidery frames is usable for sewing the edited embroidery pattern based on embroidery data for the edited embroidery pattern; and reporting when at least one embroidery frame determined to be usable in the determining step after editing is different from at least one embroidery frame determined to be usable in the determining step before editing, wherein the reporting is made by a blinking visual notification, an audible notification, or a combination of both.

11. The method according to claim 10, wherein the controlling step includes:

controlling the display to display, in a first display mode, each embroidery frame determined to be usable in the determining step before editing, and to display, in a second display mode, each embroidery frame determined to be unusable in the determining step before editing, the second display mode being distinguishable from the first display mode; and controlling the display to display, in the first display mode, each embroidery frame determined to be usable in the determining step after editing, and to display, in the second display mode, each embroidery frame determined to be unusable in the determining step after editing; and wherein the reporting step includes blinking, on the display, each embroidery frame determined to be usable in the determining step after editing.

12. The method according to claim 11, wherein each embroidery frame is displayed with solid lines in the first display mode.

13. The method according to claim 11, wherein each embroidery frame is displayed in gray in the second display mode.

14. The method according to claim 11, wherein the reporting step further includes generating a warning sound.

15. The method according to claim 10, wherein the controlling step includes:

controlling the display to display, in a first display mode, each embroidery frame determined to be usable in the determining step before editing, and to display, in a second display mode, each embroidery frame determined to be unusable in the determining step before editing, the second display mode being distinguishable from the first display mode; and controlling the display to display, in the first display mode, each embroidery frame determined to be usable in the determining step after editing, and to display, in the second display mode, each embroidery frame determined to be unusable in the determining step after editing; and wherein the reporting step includes blinking, on the display, each embroidery frame determined to be unusable in the determining step after editing.

16. The method according to claim 10, wherein the controlling step includes:

controlling the display to display each embroidery frame determined to be usable in the determining step before editing; and controlling the display to display each embroidery frame determined to be usable in the determining step after editing; and wherein the reporting step includes blinking, on the display, each embroidery frame determined to be usable in the determining step after editing.

17. The method according to claim 10, wherein the controlling step includes:

controlling the display to display, in a first display mode, each embroidery frame determined to be usable in the determining step before editing; and controlling the display to display, in the first display mode, each embroidery frame determined to be usable in the determining step after editing, and to display, in a second display mode, each embroidery frame determined to be unusable in the determining step after editing, the second display mode being distinguishable from the first display mode; and wherein the reporting step includes blinking, on the display, each embroidery frame determined to be usable in the determining step after editing.

18. The method according to claim 10, wherein the controlling step includes:

controlling the display to display, in a first display mode, each embroidery frame determined to be usable in the determining step before editing; and controlling the display to display, in the first display mode, each embroidery frame determined to be usable in the determining step after editing, and to display, in a second display mode, each embroidery frame determined to be unusable in the determining step after editing, the second display mode being distinguishable from the first display mode; and wherein the reporting step includes blinking, on the display, each embroidery frame determined to be unusable in the determining step after editing.

19. An embroidery data editor comprising:

a display;

a memory; and a controller that:

selects a desired embroidery pattern from a plurality of embroidery patterns;

controls the display to display the selected embroidery pattern;

edits the embroidery pattern displayed on the display;

determines, using a first determining portion, before the selected embroidery pattern is edited, whether each of a plurality of embroidery frames is usable for sewing the selected embroidery pattern based on embroidery data for the selected embroidery pattern;

stores, in the memory, first embroidery frame data indicative of at least one embroidery frame determined to be usable by the first determining portion;

determines, using a second determining portion, after the selected embroidery pattern is edited, whether each of the plurality of embroidery frames is usable for sewing the edited embroidery pattern based on embroidery data for the edited embroidery pattern;

stores, in the memory, second embroidery frame data indicative of at least one embroidery frame determined to be usable by the second determining portion;

determines whether the second embroidery frame data is different from the first embroidery frame data; and reports when the second embroidery frame data is different from the first embroidery frame data, indicating that at least one embroidery frame determined to be usable by the second determining portion is different from at least one embroidery frame determined to be usable by the first determining position.

20. A method of displaying each embroidery frame usable for a selected embroidery pattern, the method comprising:

(a) selecting a desired embroidery pattern from a plurality of embroidery patterns;

(b) controlling a display to display the embroidery pattern selected in step (a);

(c) editing the embroidery pattern displayed on the display;

(d) determining, before the embroidery pattern selected in step (a) is edited in step (c), whether each of a plurality of embroidery frames is usable for sewing the selected embroidery pattern based on embroidery data for the selected embroidery pattern;

(e) storing, in a memory, first embroidery frame data indicative of at least one embroidery frame determined to be usable in step (d);

(f) determining, after the embroidery pattern selected in step (a) is edited in step (c), whether each of the plurality of embroidery frames is usable for sewing the edited embroidery pattern based on embroidery data for the edited embroidery pattern;

(g) stores, in the memory, second embroidery frame data indicative of at least one embroidery frame determined to be usable in step (f);

(h) determines whether the second embroidery frame data is different from the first embroidery frame data; and (i) reporting when the second embroidery frame data is different from the first embroidery frame data, indicating that at least one embroidery frame determined to be usable in step (f) is different from at least one embroidery frame determined to be usable in step (d).

* * * * *